US007025598B2

(12) United States Patent
Ikeda

(10) Patent No.: US 7,025,598 B2
(45) Date of Patent: Apr. 11, 2006

(54) COAXIAL ELECTRICAL CONNECTOR

(75) Inventor: Kazuhiko Ikeda, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/007,269

(22) Filed: Dec. 9, 2004

(65) Prior Publication Data

US 2005/0136700 A1 Jun. 23, 2005

(30) Foreign Application Priority Data

Dec. 19, 2003 (JP) ..... 2003-423075

(51) Int. Cl.
*H01R 12/00* (2006.01)

(52) U.S. Cl. ..... 439/63; 439/582

(58) Field of Classification Search ..... 439/63, 439/394, 578–585, 675, 852, 736, 654, 859, 439/607, 638, 608
See application file for complete search history.

(56) References Cited

U.S. PATENT DOCUMENTS 5,263,877 A * 11/1993 Mitani ..... 439/582
5,772,470 A 6/1998 Togashi
5,879,190 A * 3/1999 Maruyama et al. ..... 439/582
6,503,100 B1 * 1/2003 Yamane ..... 439/582
6,508,668 B1 * 1/2003 Yamane ..... 439/582
6,712,645 B1 * 3/2004 Chou ..... 439/582
6,790,082 B1 * 9/2004 Obayashi ..... 439/582
2002/0187660 A1 12/2002 Obayashi

FOREIGN PATENT DOCUMENTS

EP 0739059 A2 10/1996
EP 1073146 A1 1/2001
JP 2001-43939 2/2001

* cited by examiner

*Primary Examiner*—Gary F. Pham
*Assistant Examiner*—Edwin A. Leon
(74) *Attorney, Agent, or Firm*—Takeuchi&Kubotera, LLP

(57) ABSTRACT

A coaxial electrical connector includes an outer conductor (11) having a cylindrical fitting section (14) to fit onto the counter connector (60), a dielectric (12) placed in the outer conductor (11) and a center conductor (13) which is held by the dielectric (12). It further includes a cover section (16) to cover the other opened end of the cylindrical fitting section (14), and a surrounding section (17) to surround the cable C, which is connected to the connecting section (24) of the center conductor. The cover section (16) and the surrounding section (17) are bent at a linking section (18). The cover section (16) has a receiving section (19) on the inner surface which contacts with the tongue (22) of the dielectric (12), in order to place at least a part of the tongue (22) therein.

8 Claims, 7 Drawing Sheets

COAXIAL ELECTRICAL CONNECTOR

BACKGROUND OF THE INVENTION

1. Field of the Invention

The present invention relates to a coaxial electrical connector, especially a right angle coaxial electrical connector.

2. Description of the Related Art

As for the right angle electrical connector, the one disclosed in Patent Reference JP 2001-43939 is known.

As shown in FIG. 5, the connector 50 of the Patent Reference is fitted and connected onto the counter connector 60, which is arranged on a circuit board P, in the direction vertical to the circuit board. The counter connector 60 has a cylindrical outer conductor 61, a center conductor 62 arranged in the center of the outer conductor 61, and a dielectric 63 which is molded between those conductors as a unitary piece. The outer conductor 61 is formed to have a cylindrical shape by rolling and jointing two edges of a metal sheet piece. The outer conductor 61 has a locking groove 61A on the outer circumferential surface. The center conductor 62 has a rod-like contact section 62A, and a connecting section 62B which is formed as an L-shape arm extending from the lower end of the contact section 62A. The dielectric 63 is arranged only in lower portion of the counter connector 60. Above the dielectric 63, an annular receiving space is formed between the outer conductor 61 and the contact section 62A of the center conductor 62.

The outer conductor 51 of the connector 50 which is fitted and connected onto the counter connector 60 has a cylindrical fitting section 51A, a cover section 51B, a frame-like section 51C, and a cable holding section 51D. The outer conductor 51 is made by punching and bending a metal sheet to form the shape. As also shown in FIG. 6, the cylindrical fitting section 51A has a jointing section 51A1 at its upper half portion, and has a cylindrical shape. An annular protrusion 51E for locking the fitting of the connectors is provided on the inner surface of the cylindrical fitting section 51A by making an annular groove on the outer surface of the cylindrical fitting section 51A. A plurality of slits 51F is provided at the lower half portion of the cylindrical fitting section 51A along its circumferential direction, so as to cross the annular protrusion 51E. The frame-like section 51C is provided so as to protrude in the radial direction of the fitting section 51A from a part of the upper portion of the fitting section 51A.

The outer conductor 51 holds the dielectric 52, while the dielectric 52 holds a terminal 53, which is a center conductor of the connector 50. As shown in FIG. 6, the cover section 51B and the holding section 51D of the outer conductor 51 are provided opposite the frame-like section 51C in the radial direction, and extend upward from the upper edge of the cylindrical fitting section 51A. After the dielectric 52 and the terminal 53 which is already connected to a cable are held in the cylindrical fitting section 51A, the cover section 51B and the surrounding section 51D are bent downward for 90 degree, as shown in FIG. 5. The cover section 51B and the cylindrical fitting section 51A are connected via a narrow linking section 51G, where the cover section 51B is bent. The dielectric 52 holds the terminal 53, and has a terminal hole 52A to house spring contact sections 53A of the terminal 53. The dielectric 52 also has a tongue 52B which extends upward and can be bent at its base and a cable receiving section-52D having a cable guiding groove 52C. The tongue 52B is bent being pressed by the cover section 51B of the outer conductor 51, while it slides over the inner surface of the cover section 51B along the extending direction (longitudinal direction) of the tongue 52B.

In this connector 50, as shown in FIG. 6, after the core-wire C1 of the coaxial cable C is connected by soldering onto the upper surface of the terminal 53, the contact sections 53A of the terminal 53 are inserted into the terminal hole 52A of the dielectric 52. Then, the outer conductor 51 is bent at the linking section 51G while pushing the tongue 52B of the dielectric 52 (See FIG. 5), and then the holding section 51D is bent so as to tightly hold the frame-like section 51C and the cable C.

Once the connector 50 is fitted onto the counter connector 60, the contact sections 53A of the terminal of the connector 50 contact with the center conductor 62 of the connector 60 by pinching it. While the cylindrical fitting section 51A of the outer conductor 51 of the connector 50 enlarges its diameter, it contacts with the outer circumferential surface of the outer conductor 61 of the connector 60, and the connector 50 is locked not to come off by the fitting of the annular protrusion 51E to the annular locking groove 61A.

In the connector of the Patent Reference, when the tongue 52B of the dielectric 52 is bent being pushed by the cover section 51B of the outer conductor 51, since the inner surface of the cover section 51B is flat, the tongue 52B can slide obliquely over the inner surface of the cover section, as shown with the dashed line having one long dash and two short dashes in FIG. 7. The sliding off of the tongue can be occurred even by slight asymmetry in the strength of the tongue 52B, or by slight asymmetry in the pressure applied by the cover section. With those slight asymmetries, the tongue could unacceptably slide off. If the tongue is in a wrong position and pressed by the cover section, the tongue cannot be correctly placed in the groove on the upper surface of the main body of the dielectric, so that the cover section is held unstably above the intended position. In this case, the dimension of the connector in the height direction can be larger than the intended dimension, and also the holding of the tongue can be unstable. In some cases, the electrical properties of the connector can be deteriorated by the sliding off of the tongue.

Furthermore, the sizes of electrical devices have been dramatically reduced in these years, and in case of the connector, the dimension in the height direction, i.e. the dimension in the fitting direction, is required to be small. In case of the connector disclosed in the Patent Reference 1, however, since the inner surface of the cover section is flat, even if the tongue is correctly bent at the correct position without sliding off, the thicknesses of the cover section and the tongue are added above the main body of the dielectric, so that the profile of the connector cannot be reduced.

SUMMARY OF THE INVENTION

In view of the above problems, it is an object of this invention to provide a coaxial electrical connector, in which the tongue of the dielectric can be correctly bent without sliding off, and the profile of the connector is made small by reducing the total dimension of the tongue and the cover section in the height direction.

According to the invention there is provided a coaxial electrical connector which includes an outer conductor which has the cylindrical fitting section that has its axis in its fitting direction to the counter connector and is opened at one end for the fitting, a dielectric placed in and held by the cylindrical fitting section, and a center conductor that is held in the dielectric and has a contact section extending in the axial direction of the cylindrical fitting section. The outer conductor further comprises a cover section to cover the upper opened end of the cylindrical fitting section, and a surrounding section to surround a cable extending in the radial direction of the cylindrical fitting section. The cover section and the surrounding section are formed by bending the portion, which extends upward in the axial direction of the cylindrical fitting section from a part of the upper opened end of the cylindrical fitting section, at the linking section between the cylindrical fitting section and the cover section. The dielectric has a tongue extending along the cover section from a part of the upper edge of the dielectric, corresponding to the cover section of the outer conductor. When the cover section is bent at the linking section, the tongue is placed in the cover section.

In the connector of this invention, a receiving section to receive at least a part of the tongue when the cover section is bent at the linking section is formed on the inner surface of the cover section.

According to such constitution of this invention, since at least a part of the tongue is placed in the receiving section which is formed on the tongue, the position of the tongue will not be off even after the connector is assembled. In addition, the height of the connector can be reduced for the thickness of the tongue placed in the receiving section.

In this invention, the receiving section can be a concave section formed by punching. If it is made by punching, only the concave section can be formed on the inner surface without forming a convex section on the outer surface of the cover section. In addition, since local increase of the thickness by the tongue can be prevented, the dimension of the connector in the height direction does not have to be increased.

In case that the receiving section is formed as the concave section, the thickness of the cover section is locally smaller, and the strength at the thinner portion is reduced. Therefore, it is preferred to form a reinforcing section on a part of the cover section other than the receiving section so as to compensate for the reduced strength caused by forming the receiving section.

In this invention, the shape of the upper surface of the connecting section of the center conductor is preferably similar to the shape of the inner surface, so that the high-frequency properties of the connector can be satisfactorily maintained.

As for the center conductor, the contact section and the connecting section can be formed to generally have an L-shape. In this case, the receiving section is preferably a concave section to place at least a part of the tongue therein. The connecting section preferably has an angled section on the upper surface, which is angled upward toward the cable side along the extending direction of the cable. The step-like section of the concave section on the side opposite the cable is preferably provided corresponding to the position of the angled section in the extending direction. With this constitution, when the cover section is bent, the terminal can be pressed toward the cable, contact with the reference surface for positioning and can be precisely positioned.

Furthermore, in this invention, the cover section can have a restricting section on the inner surface, which restricts the sliding off of the tongue in the width direction when the cover section is bent and the tongue slides over the inner surface of the cover section in the extending direction of the tongue. With those features, the tongue can stay in the intended position without sliding off in the width direction of the tongue when it is bent.

As described above, in the present invention, the receiving section to place at least a part of the tongue of the dielectric is formed, or the restricting section to restrict the movement of the tongue in the width direction is provided on the inner surface of the cover section of the outer conductor. Therefore, the sliding off of the tongue in the width direction when the tongue is bent by the cover section is prevented, and the tongue can be placed in the intended position. Even at the time of and after completing the assembly of the connector, the tongue can securely stay in the position, so that there is no concern of instability of the position in the height direction. Moreover, if a part of the tongue is placed in the receiving section, the dimension of the connector in the height direction can be reduced for the height of the tongue placed in the receiving section. On the other hand, if the restricting section is provided on the inner surface of the cover section, the sliding off of the tongue in the width direction can be prevented when the cover section is bent at the linking section, and the position of the tongue can be maintained.

DESCRIPTION OF THE PREFERRED EMBODIMENTS

Figure 1:
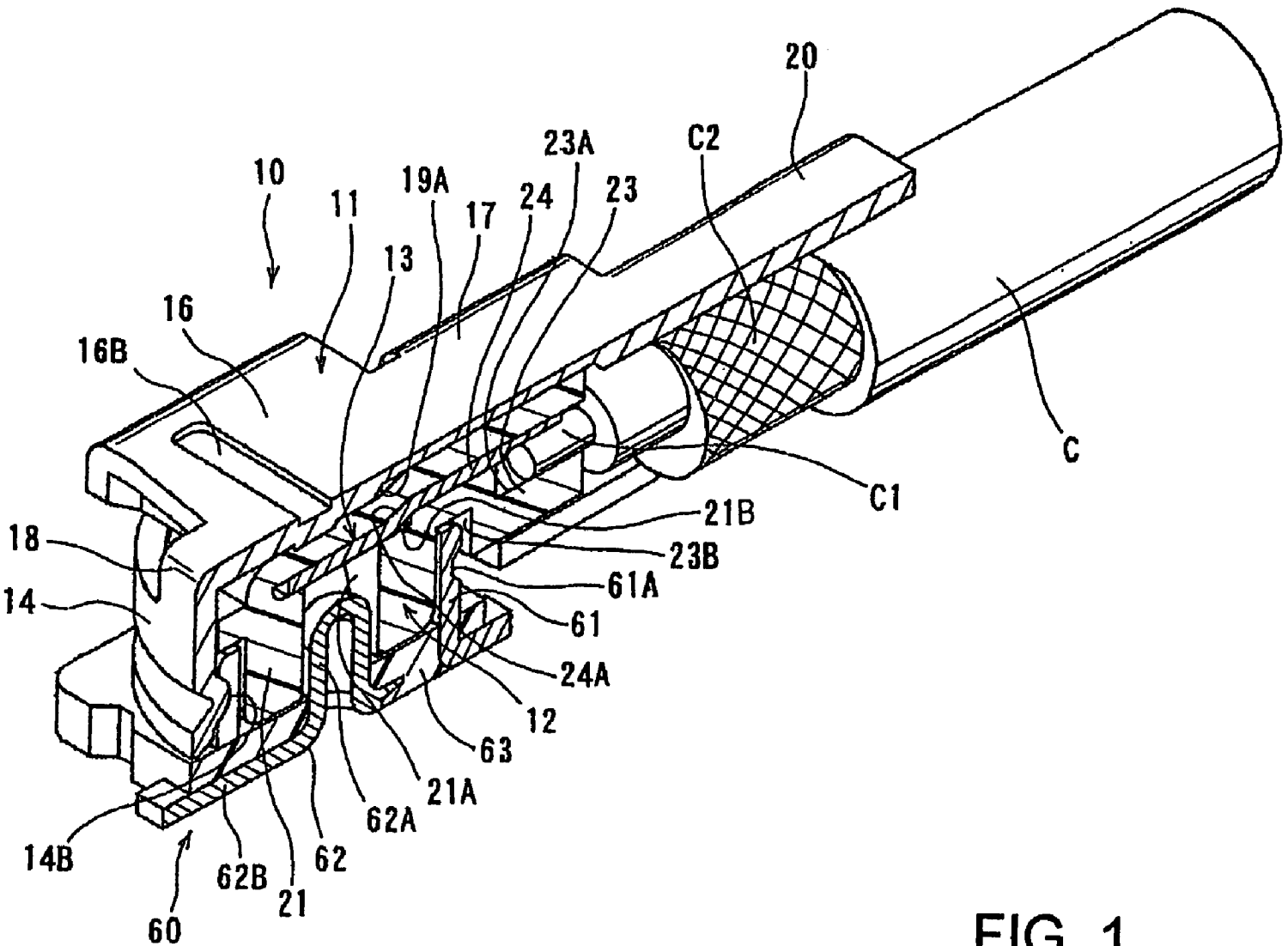
FIG. 1 is a cross-sectional view, taken along the plane including the axis of the cable, of a coaxial electrical connector according to an embodiment of the invention when it is connected to a cable.
Figure 2:
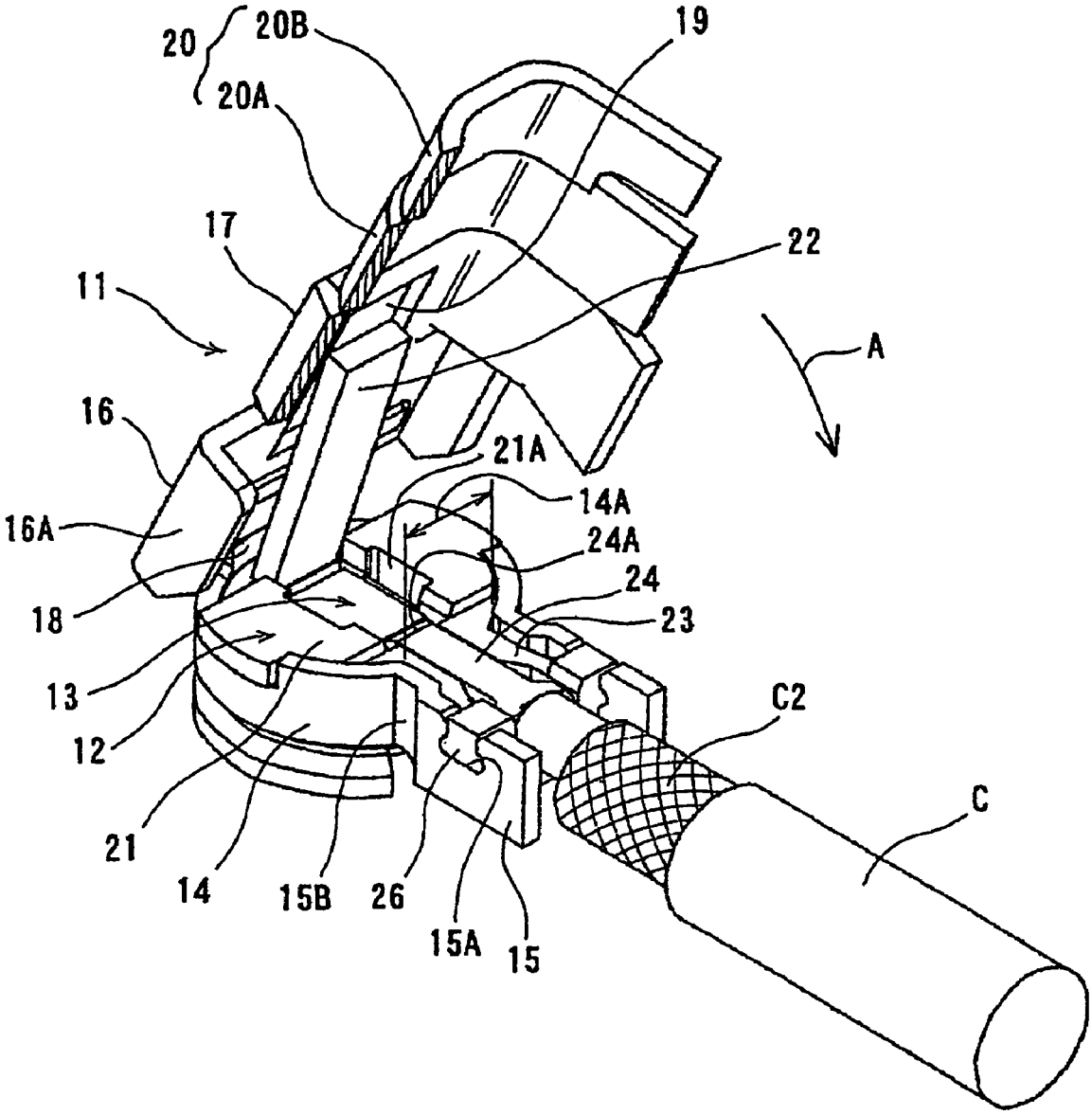
FIG. 2 is the perspective view of the connector of FIG. 1 in the process of assembling.
Figure 3:
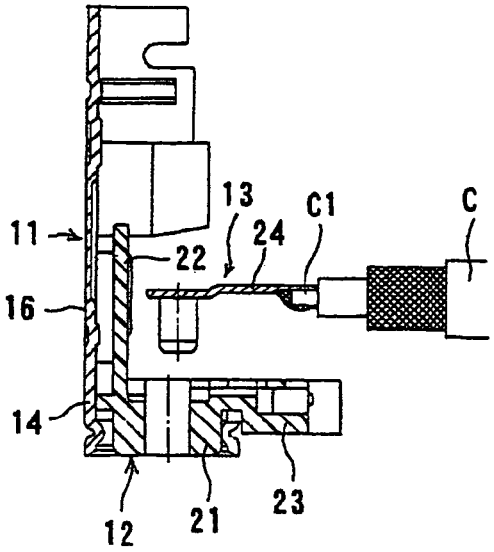
FIG. 3(A) is a sectional view of the connector before the terminal is inserted therein.
FIG. 3(B) is a sectional view of the connector after the terminal is inserted therein but before the cover section is bent.
FIG. 3(C) is a sectional view of the connector after the cover section is bent and the portion is tightly held by the surrounding section and the holding section.
FIG. 3(D) is an elevational view as viewed from the right of FIG. 3(B)
Figure 3:
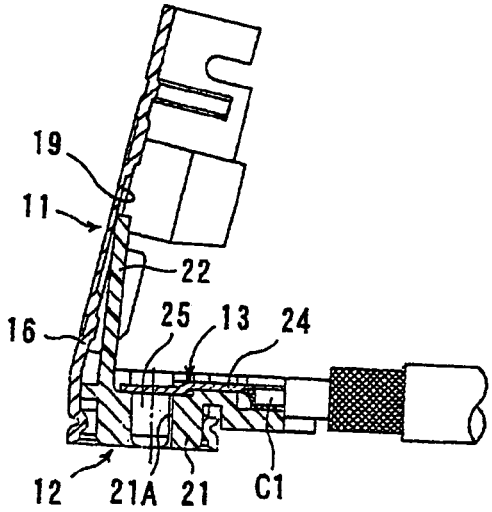
Figure 3:
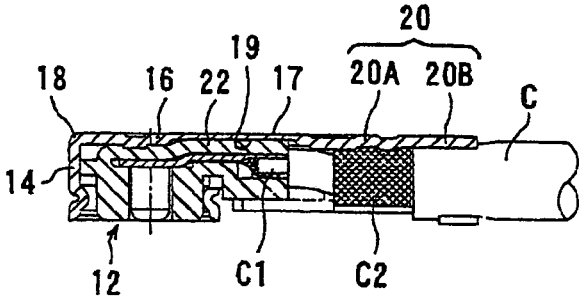
Figure 3:
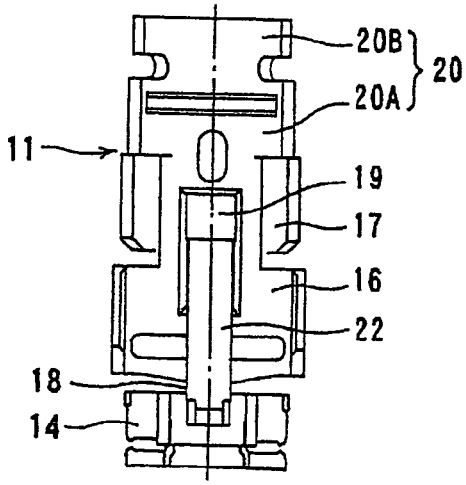
Figure 5:
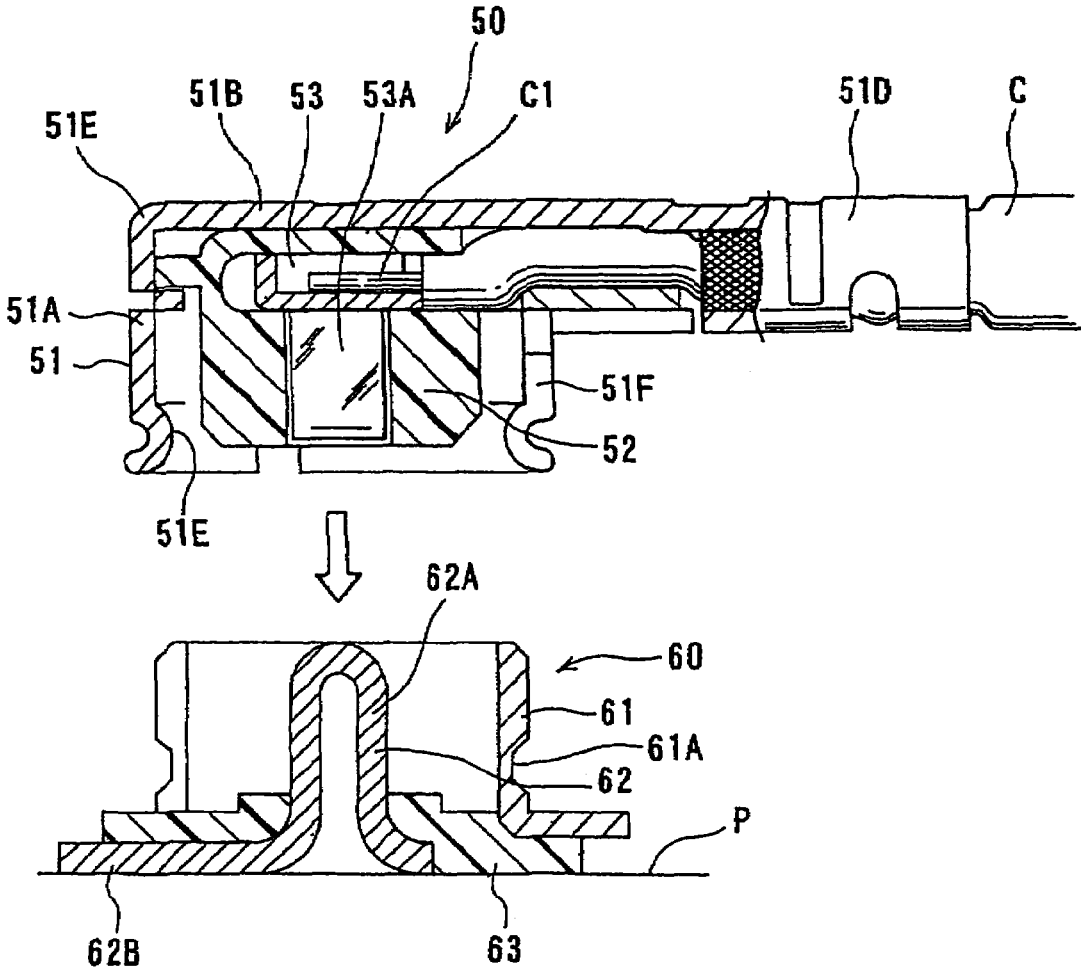
PRIOR ART FIG. 5
FIG. 5 is a cross-sectional view of the conventional connector and the counter connector before fitting.
Figure 6:
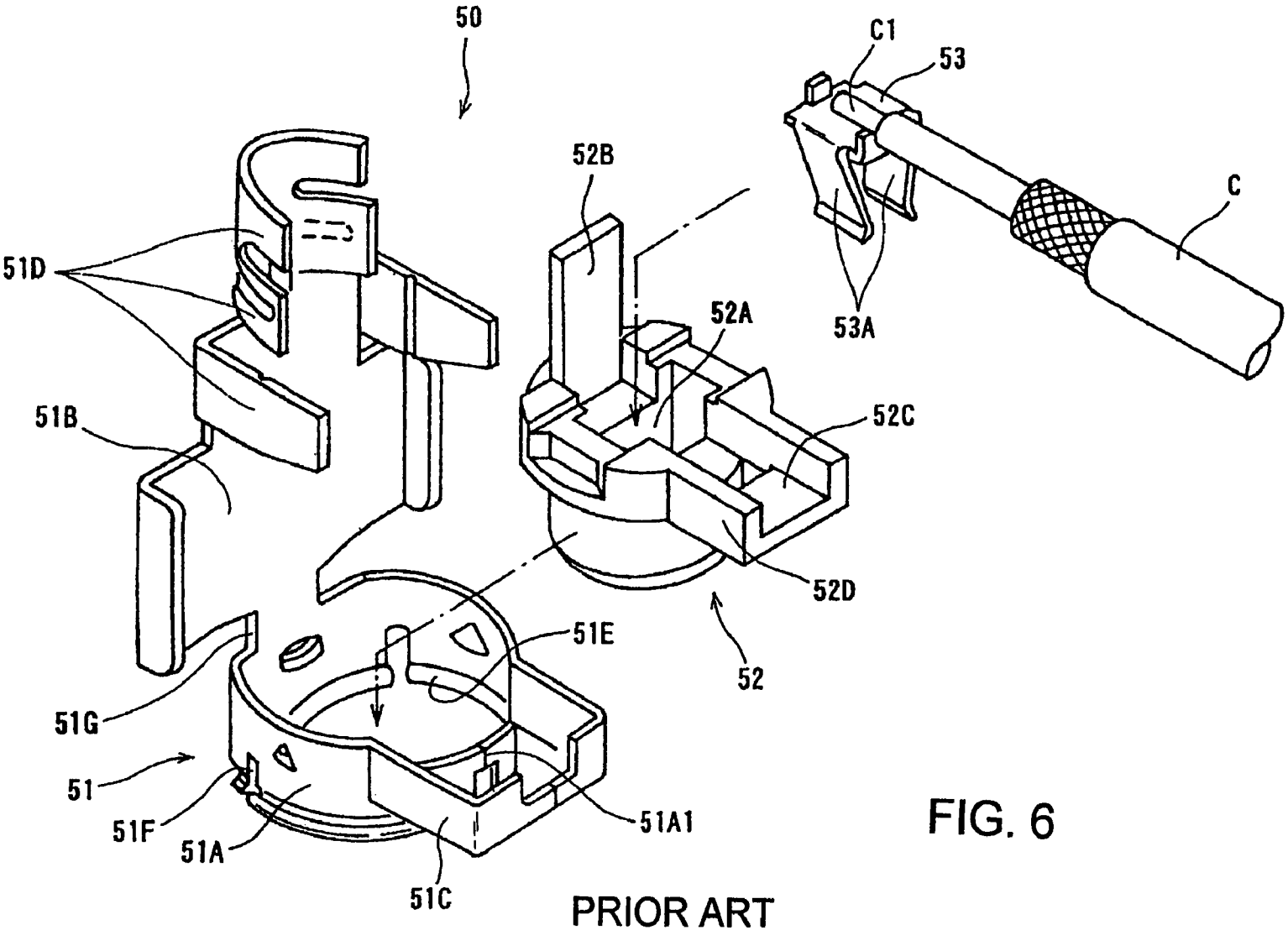
FIG. 6 PRIOR ART
FIG. 6 is an exploded perspective view of the outer conductor, dielectric and the center conductor as the terminal of the connector of FIG. 5 before assembling the connector.
Figure 7:
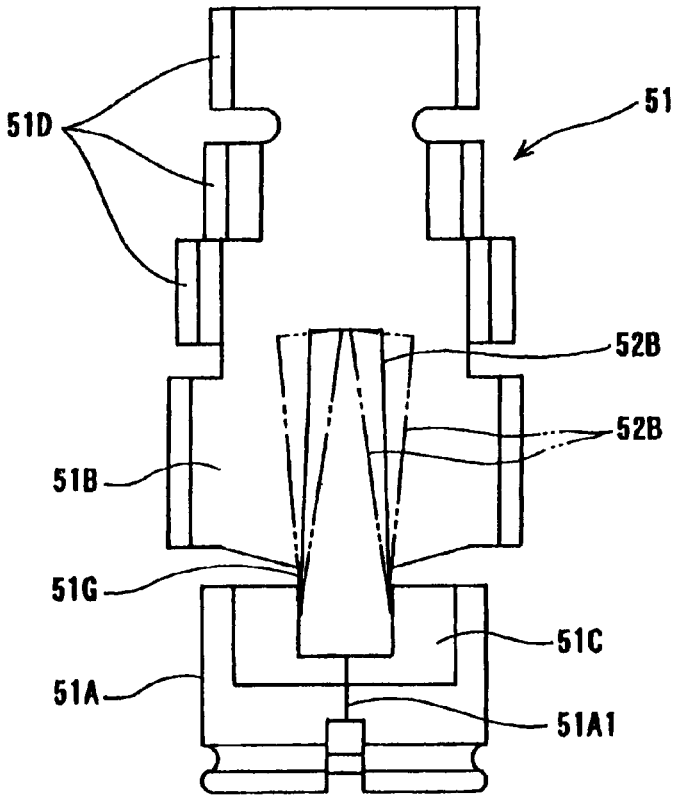
FIG. 7 PRIOR ART
FIG. 7 is an elevational view, as viewed from the cable side, of the outer conductor and the tongue of the dielectric disposed when the outer conductor of the connector of FIG. 6 is bent.

In FIGS. 1–3, the coaxial connector 10 is to be connected to the counter connector 60 which is mounted onto a circuit board (See FIG. 1). This counter connector 60 is not a part of this invention, and is same as a conventional connector shown in FIG. 5. Therefore, same reference numerals are used for the same parts as in FIG. 5, and the explanation is omitted. The coaxial connector 10 of this embodiment which is to be connected to the counter connector 60 is so-called "right angle connector", in which the connector fits to the counter connector in the direction perpendicular to the extending direction of the cable. As shown in FIGS. 1 and 2, this connector comprises an outer conductor 11, a dielectric 12 and a terminal 13 which is a center conductor.

The outer conductor 11 is formed by first forming the outer shape by punching and then bending a metal sheet, and has a cylindrical fitting section 14, arms 15, a cover section 16 and a surrounding section 17 as a unitary piece. The cylindrical fitting section 14 is formed by rolling a metal sheet to form the cylindrical shape, and has an opening 14A of a certain width on the circumferential wall, which is opened for placing a cable C (See FIG. 2). A locking section which engages with an annular locking groove 61A that is formed on the outer surface of the outer conductor 61 of the connector counter connector, is formed on the lower portion of the inner surface of the cylindrical fitting section 14 as an annular protrusion 14B (See FIG. 1).

As shown in FIG. 2, a pair of flat arms 15 which extend from the opening 14A in the radial direction of the fitting section 14 and are parallel to each other, is formed at the upper half portion of the cylindrical fitting section 14. Narrowing sections 15B, which have smaller distance from each other than the distance between the arms 15, are formed at the boundary portions between the opening 14A and the arms 15. Preferably, the distance between the inner surfaces of the narrowing sections 15B is set as small as the minimum distance required to dispose the connecting section of the terminal that extends in the radial direction and the dielectric that supports the connecting section. Each narrowing section 15B directly extends from the circumferential wall of the cylindrical fitting section 14. In the height direction, i.e. the axial direction of the cylindrical fitting section 14, the arms 15 has larger dimension than the narrowing sections 15B so as to extend to a height level of the annular protrusion of the cylindrical fitting section 14B. Latching grooves 15A which are formed like dovetail grooves are formed at the upper edges of the arms, and are opened upward.

The cover section 16 and the surrounding section 17 extend via the linking section 18 from a part of the upper opened end of the cylindrical fitting section, which is opposite the opening 14A in the radial direction of the cylindrical fitting section. The surrounding section, the cover section, the linking section and the fitting section are formed together as a unitary piece. Once the cover section 16 is bent toward the cable C as shown in FIG. 2, the upper opened end of the cylindrical fitting section 14 is generally covered. The cover section 16 has shoulders 16A at the side edges, which are bent downward. Once the cover section is bent toward the fitting section, the shoulders 16A are placed outside of the cylindrical fitting section 14.

The outer conductor 11 has the surrounding section which extends from the cover section 16. The surrounding section 17 generally covers the arms in the extending direction of the cable, and forms a rectangular cylindrical shape which covers the arms in the width direction when the surrounding section 17 is bent toward the arms. In this embodiment, when the surrounding section 17 is bent so as to form the rectangular cylindrical shape, it partially covers the narrowing sections at its one end and covers a portion farther than the free ends of the arms at the other end. A space is formed between the narrowing sections 15B and the inner surface of the surrounding section.

A restricting concave section 19 is formed on the inner surface of the cover section 16 and the surrounding section 17. This restricting concave section 19 is formed thereon by punching without making a protrusion but keeping a flat surface on the outer surface of the cover section 16 and the surrounding section 17. Therefore, the thickness of the restricting concave section 19 is smaller than that of other portions of the cover section and the surrounding section. The restricting concave section 19 is formed to have a rectangular shape having its longitudinal direction along the extending direction of the cable, and partially houses the tongue of the dielectric, which will be described below, in the thickness direction. In this embodiment, the restricting concave section 19 is formed on the inner surface of the cover section 16 and the surrounding section 17. If the length of the tongue is short, the restricting concave section 19 can be formed only on the inner surface of the cover section 16. When the tongue is bent with the cover section, the restricting concave section 19 works as a section which restricts the sliding off of the tongue in the width direction. On the other hand, at the time of completing assembly of the connector, it works as a receiving section which places at least a part of the tongue therein in the thickness direction.

In addition, as shown in FIG. 1, a reinforcing section 16B is formed on the outer surface of the cover section, which is other than the area corresponding to the restricting concave section 19 (See FIG. 1). In this embodiment, the reinforcing section 16B is provided as an embossed section which is dented on the outer surface and protrudes on the inner surface. The reinforcing section 16B is provided to improve the strength of the cover section 16. By forming the reinforcing section near the restricting concave section, the reduction of the strength of the cover section caused by the formation of the restricting concave section 19 can be compensated. Preferably, the reinforcing section is formed outside the area that corresponds to the restricting concave section 19 but close to the restricting concave section 19, and extends in the direction vertical to the longitudinal direction (extending direction of the cable) of the restricting concave section 19, as shown in the embodiment in FIG. 1.

A holding section 20 to hold the cable C is provided from the end of the surrounding section opposite the cover section 16. The holding section 20 is formed to form a rectangular cylindrical shape similarly to the surrounding section 17 when it is bent, and comprises a first holding section 20A and a second holding section 20B (See FIG. 2). Those holding sections 20A and 20B have different dimensions in the width direction, so as to be capable of tightly holding the respective cable portions having different thickness. More specifically, the first holding section is designed to tightly hold the cable over the shielding wire (C2), and the second holding section 20B is designed to tightly hold the cable over its outer coating.

The dielectric 12 of the connector 10 is covered and held by the above-described outer conductor 11. The dielectric 12 is made by molding a plastic resin, which is an electric insulating material, and has a main body section 21, a tongue 22 and a cable receiving section 23 as a unitary piece. The lower part of the main body section 21 is shaped so as to be placed in the outer conductor 61 of the counter connector 60, and the upper part of the main body 21 is held by the outer conductor 11.

A hole 21A having a rectangular cylindrical shape is formed at the center part of the main body 21 to receive the contact section of the terminal that will be described below. In addition, the dielectric 12 has the cable receiving section 23 which extends in the extending direction of the cable from the upper portion of the main body 21. Side surfaces of the cable receiving section are formed along the inner surfaces of the arms 15 of the outer conductor 11, and the lower surface of the cable receiving section 23 is formed so as to be along the surrounding section 19 when it is bent to cover the portion. The cable receiving section 23 is designed to have a space in the height direction to receive the connecting section of the terminal, the cable and the tongue 22. In addition, since the dimensions of the connecting section of the terminal and the core-wire C1 of the cable C to be connected to the connecting section are different in the height direction, a step-like section 23A to receive the core-wire C1 is formed partially on the upper surface of the cable receiving section 23. On the lower surface of the cable receiving section 23, a groove 23B, into which the outer conductor 61 of the counter connector can be placed, is formed. A positioning step-like section 21B is formed on the upper surface of the main body 12 of the dielectric 12, being slightly closer to the cable in the cable's extending direction than the step-like section 19A of the restricting concave section 19 which is formed on the inner surface of the cover section 16.

As shown in FIG. 2, the tongue 22 is formed as a flat piece extending upward being adjacent to the linking section 18 of the outer conductor 11. The tongue 22 has a suitable width to be housed in the restricting concave section 19 which is formed on the inner surface of the cover section 16 and the surrounding section 17 of the outer conductor 11. When the cover section 16 is bent at the linking section 18, the tongue 22 is bent with the cover section being pushed by the cover section 16, and placed in the restricting concave section 19.

In addition, the dielectric 12 has latching protrusions 26 which engage with the latching grooves 15A being pressed from their upper sides into the latching groove formed on the arms 15 of the outer conductor 11.

As shown in FIG. 1, the terminal 13 has a connecting section 24 which is generally flat and extends along the extending direction of the cable C, and has a pair of flat contact sections 25 which extend downward along the fitting direction of the connectors from the connecting section 24. The connecting section 24 extend to almost near the end of the tongue 22 after bent, and tightly held between the tongue 22 and the upper surface of the main body 21 of the dielectric 12. The whole range of the connecting section 24 is covered in the extending direction by the tongue 33 of the dielectric 12. The connecting section 24 has a thinner portion, which is formed by punching, on the lower surface of its end where the connecting section is connected to the core-wire of the cable C.

The connecting section 24 also has a small part of angled section 24A at the middle part of the terminal, corresponding to the positioning step-like section 21A of the main body 21 of the dielectric 12 (See FIG. 1). As shown in FIG. 1, the angled section 24A is formed, so as to correspond to the positions of the step-like section 19A of the restricting section 19 and the positioning step-like section 21A. In addition, by providing such angled section 24A, the connecting section 24 has a shape similar to that of the inner surface of the cover section 16 of the outer conductor 11 which has the restricting concave section 19 thereon, so that the distance between the inner surface of the cover section 19 and the connecting section 24 can be generally same through the connecting section, and the electrical properties can be satisfactorily maintained. Moreover, the connecting section 24 of the terminal is angled upward toward the cable side by the angled section 24A, and under the angled section, the main body of the dielectric has a groove 23B for receiving the upper edge of the outer conductor 61 of the counter connector 60. Therefore, without increasing the height of the connector, the groove 23B can be made deep. In addition, the angle of the angled section 24A can be any, and can be almost 90 degrees. The distance between the pair of the contact sections 25 is set to tightly press the rod-like contact section 62A of the center conductor 62 of the counter connector 60.

The procedure for assembling and how to use the above-described connector are described below.

(1) First, the core-wire C1 of the cable C, which is exposed at the end by removal of the outer coating and so on, is connected by soldering to the connecting section 24 of the terminal 13. This connection by soldering is done at the lower surface of the end portion of the connecting section, which is dented and has a smaller thickness (See FIG. 3(A)).

(2) Next, as shown in FIG. 3(A), after or before the connection described in (1), the dielectric 12 is placed onto the outer conductor 11. More specifically, the main body 21 and the cable receiving section 22 of the dielectric 12 are placed in the cylindrical fitting section 14 and between the pair of arms, respectively. The latching protrusions 26 formed on the side surfaces of the cable receiving section 23 are pressed in the latching grooves 15A (See FIG. 2). At this time, the tongue 22 of the dielectric 12 and the cover section 16 of the outer conductor 11 are not bent yet, therefore still extend upward.

(3) Thereafter, as shown in FIG. 3(B), the contact sections 25 of the terminal 13 is inserted and arranged in the hole 21A formed on the main body of the dielectric 12. This arrangement of the contact sections 25 into the hole 21A can be done outside the outer conductor 11 before placing the dielectric onto the outer conductor 11. At this time, the core-wire Cl of the cable can be soldered to the connecting section 24.

(4) Next, as shown in FIG. 2, the cover section 16 and the surrounding section 17 of the outer conductor 11 are bent at the linking section in the direction of the arrow A, so as to be bent toward the cable C (See FIG. 3(C)). At the time of bending, the tongue 22 of the dielectric 12 is placed in the restricting concave section 19, which is formed on the inner surface of the cover section 16 and the surrounding section 17 of the outer conductor 11. Therefore, the movement of the tongue in the width direction is restricted but it slides on the lower surface of the restricting concave section along the longitudinal direction.

(5) Once the cover section 16 and the surrounding section 17 are completely folded by bending at the linking section 18, the cover section 16 covers the upper portion of the cylindrical fitting section 14 of the outer conductor 11, and the surrounding section 17 covers the cable C held in the cable receiving section 23, and the holding section 20 contacts with the cable. In addition, the cover section 16 and the surrounding section 17 hold the terminal via the tongue 22.

(6) Thereafter, the surrounding section 17, the first holding section 20A and the second holding section 20B are bent so as to surround the cable and the other portions. The surrounding section 17 securely surrounds and holds the arms 15, the cable receiving section 22 of the dielectric 12 disposed between the arms 15, the end of the tongue 22, and the connecting section 24 of the terminal together. The first holding section 20A and the second holding section 20B tightly hold the cable C over the shielding wire portion C2 and over the outer coating, respectively. Once the cover section is bent as described above, the angled section 24 of the connecting section 24 of the terminal 13 is pressed obliquely toward the positioning step-like section 21A of the dielectric 12 by the step-like section 19A of the cover section 16. Therefore, the terminal 13 slightly moves toward the cable side and the angled section 24A contacts with the positioning step-like section 21A. Accordingly, the positioning of the terminal 13 is done by using the positioning step-like section 21A as the reference position. In other words, the contact section 25 of the terminal 13 is accurately positioned with regard to the rod-like contact section 62A of the center conductor 62 of the counter connector 60 in the extending direction of the cable.

(7) As shown in FIG. 1, the connector assembled as described above is fitted and connected to the counter connector 60. By fitting those connectors, the terminal 13 of the center conductor of the connector 10 elastically contacts with the contact sections 62A of the center conductor 62 of the counter connector 60 at its contact section 14. In addition, the outer conductor 61 of the counter connector 61 is placed in the annular space between the cylindrical fitting section 14 of the outer conductor 11 and the dielectric 12 of the connector 10. The diameter of the annular protrusion 14B provided on the inner surface of the outer conductor 11 is enlarged by contacting with the upper edge of the outer conductor 61 of the counter connector 60, so that the connector 10 can be fitted to the counter connector 60. The diameter of the outer conductor 11 is elastically enlarged mainly around the narrowing sections 15B of the cylindrical fitting section 14, enlarging the distance between the narrowing sections 15B. Since the narrowing sections are provided being a certain distance away from each other, the enlargement of the outer conductor 11 which is required for the fitting of the connectors can be achieved without dramatically enlarging the distance between the narrowing sections. Accordingly, the circular shape of the cylindrical fitting section 14 will not be deformed so much. Therefore, the elasticity required for enlarging the diameter of the cylindrical fitting section 14 can be easily achieved and the rigidity for maintaining the shape is secured. After the elastic deformation, the annular protrusion 14B of the cylindrical fitting section 14 engages with the locking groove 61A of the counter connector 60.

It should be understood that the present invention is not limited by the embodiment illustrated in the drawings, and can be altered or modified within its scope. For example, the receiving section or the restricting section formed on the cover section and the surrounding section of the outer conductor and the tongue of the dielectric are not limited to the ones illustrated in FIGS. 1 and 2. Possible embodiments are shown in FIGS. 4(A)–4(E). Here, the tongue and the surrounding section before bending are shown in each figure, taken along a plane vertical to the longitudinal direction of the tongue.

Figure 4:
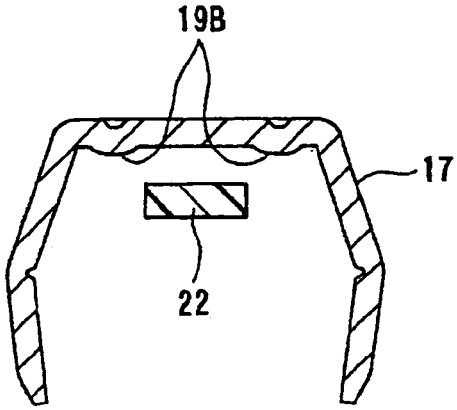
FIGS. 4(A)–4(E) are cross-sections of modifications of a tongue and a receiving or restricting section according to another embodiment of the invention.
FIG. 4(F) is a cross-section of the embodiment of FIGS. 1 and 2 for comparison with FIGS. 4(A)–4(E)
Figure 4:
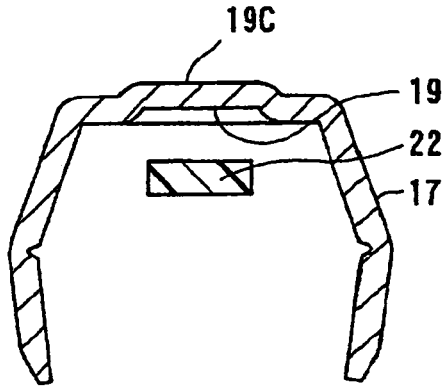
Figure 4:
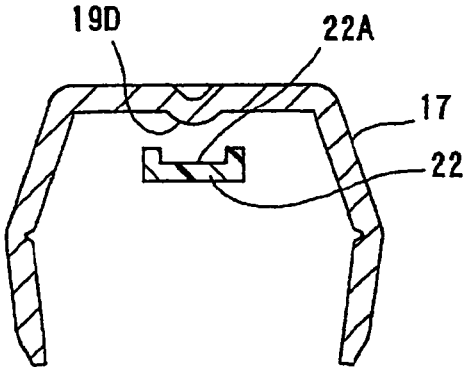
Figure 4:
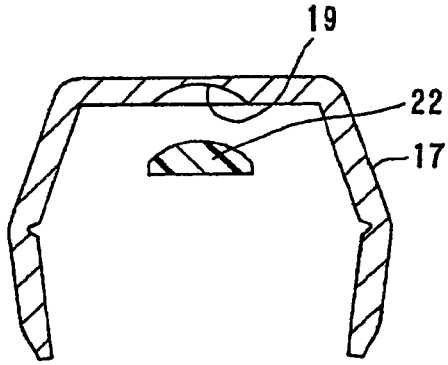
Figure 4:
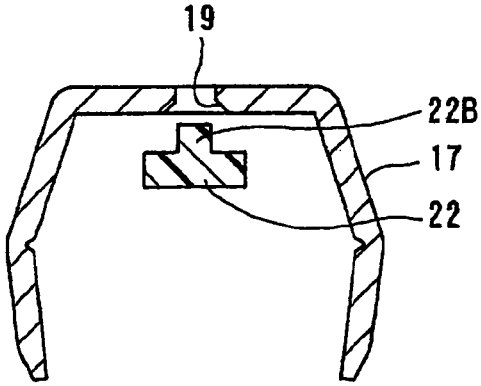
Figure 4:
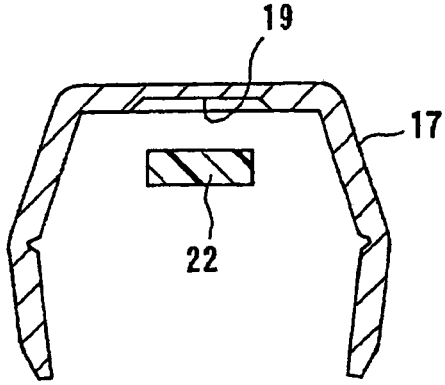

In FIG. 4(A), the tongue 22 is the same as the one in FIG. 2, but the restricting section 19B is formed as protrusions so as to restrict the movement of the tongue in the width direction by the edges. In addition, in FIG. 4(B), the restricting section 19B is formed similarly to the restricting concave section 19 of FIG. 2, but a protrusion 19C formed on the outer surface of the surrounding section 17, corresponding to the concave section 19.

In FIG. 4(C), the tongue 22 has a concave section 22A on the center part of the upper surface in the width direction, and a protrusion 19D is formed on the inner surface of the surrounding section corresponding to the concave section 22A. In FIG. 4(D), the cross-section of the tongue has convex-curved shape, while the restricting concave section 19 has a concave-curved shape corresponding to the convex shape of the tongue 22. In FIG. 4(E), the tongue 22 has a convex cross section and has a small protrusion 22B, and the restricting concave section 19 has a tapered hole to receive the protrusion 22B. Here, FIG. 4(F) illustrates the embodiment of FIGS. 1 and 2 for comparison with FIGS. 4(A)–(E).

In any of FIGS. 4(A)–(E), the tongue and the receiving section or the restricting section restricts the sliding off of the tongue in the width direction, and maintain the correct position of the tongue. In some of those examples, a part of the tongue is placed in the section in the thickness direction. Such restriction of the movement of the tongue does not have to be applied to the whole tongue, but can be applied partially.

The invention claimed is:

1. A coaxial electrical connector, comprising:

an outer conductor which is comprised of:

a cylindrical fitting section, which has an axis along a fitting direction in which said coaxial electrical connector is plugged to a counter connector and has an opened end for fitting said coaxial electrical connector to said counter connector;

a cover section that covers the other opened end of said cylindrical fitting section and has a receiving section on an inner surface thereof;

a surrounding section to surround a cable, which extends in an extending direction of the cable; and a linking section which is provided between said cylindrical fitting section and said cover section;

a dielectric which is placed in said cylindrical fitting section and has a tongue that is provided on an edge of said dielectric corresponding to a position of said linking section of said outer conductor and extends along said cover section; and a center conductor which is held by said dielectric and has a contact section that extends in a direction of said axis and a connecting section connected to said cable, wherein said cover section and said surrounding section are formed by bending at said linking section a portion extending along said direction of said axis from said other opened end of said cylindrical fitting section, said receiving section of said cover section is provided to place at least a part of said tongue in said inner surface of said receiving section when said cover section is bent, and said receiving section includes a concave portion recessed in the inner surface and has a rectangular shape extending in the extending direction of the cable for receiving the tongue.

2. The coaxial electrical connector according to claim 1, wherein said cover section has a reinforcing section on a part of said cover section other than said receiving section.

3. The coaxial electrical connector according to claims 1, wherein said contact section and said connecting section of said center conductor generally have an L-shape.

4. The coaxial electrical connector according to claim 1, wherein said connecting section of said center conductor has an upper surface having a shape similar to that, of the inner surface of said cover section of said outer conductor.

5. The coaxial electrical connector according to claim 4, wherein said contact section and said connecting section of said center conductor generally have an L-shape.

6. A coaxial electrical connector, comprising:

an outer conductor including a cylindrical fitting section having an axis along a fitting direction that the coaxial electrical connector is plugged to a counter connector and one opened end for receiving the counter connector, a cover section covering the other opened end of the cylindrical fitting section and having a receiving section on an inner surface thereof, a surrounding section for surrounding a cable extending in an extending direction thereof, and a linking section provided between the cylindrical fitting section and the cover section;

a dielectric placed in the cylindrical fitting section and having a tongue disposed on an edge thereof at a position corresponding to the linking section and extending along the cover section; and a center conductor held by the dielectric and having a contact section extending in a direction of the axis and a connecting section connected to the cable, wherein said cover section and said surrounding section are formed by bending at the linking section a portion extending from the other opened end along the direction of the axis; said receiving section accommodates at least a part of the tongue in the inner surface of the receiving section when the cover section is bent; said receiving section is a concave section in which at least the part of said tongue is placed; said connecting section has an angled section on an upper surface of said connecting section, which is angled upward toward a cable side in an extending direction of said cable; and a step-like section of said concave section on a side opposite to said cable is provided corresponding to a position of said angled section in the extending direction of said cable.

7. A coaxial electrical connector, comprising:

an outer conductor which is comprised of:

a cylindrical fitting section, which has an axis along a fitting direction in which said coaxial electrical connector is plugged to a counter connector and has one opened end for fitting said coaxial electrical connector to said counter connector;

a cover section that covers the other opened end of said cylindrical fitting section and has a restricting section on an inner surface thereof;

a surrounding section to surround a cable, which extends in a radial direction of said cylindrical fitting section; and a linking section which is provided between said cylindrical fitting section and said cover section;

a dielectric which is placed and held in said cylindrical fitting section and has a tongue that is provided on an edge of said dielectric corresponding to said linking section of said outer conductor and extends along said cover section; and a center conductor which is held by said dielectric and has a contact section that extends in said axial direction and a connecting section connected to said cable, wherein said cover section and said surrounding section are formed by bending at said linking section a portion extending along said axial direction from said other opened end of said cylindrical fitting section, and said restricting section of said cover section contacts with said tongue and restricts movement of said tongue in a widthwise direction when said tongue is bent and slides over an inner surface of said cover section in an extending direction.

8. A coaxial electrical connector, comprising:

an outer conductor including a cylindrical fitting section having an axis along a fitting direction that the coaxial electrical connector is plugged to a counter connector and one opened end for receiving the counter connector, a cover section covering the other opened end of the cylindrical fitting section and having a receiving section on an inner surface thereof with a concave section formed by punching, a surrounding section for surrounding a cable extending in an extending direction thereof, and a linking section provided between the cylindrical fitting section and the cover section;

a dielectric placed in the cylindrical fitting section and having a tongue disposed on an edge thereof at a position corresponding to the linking section and extending along the cover section; and a center conductor held by the dielectric and having a contact section extending in a direction of the axis and a connecting section connected to the cable, wherein said cover section and said surrounding section are formed by bending at the linking section a portion extending from the other opened end along the direction of the axis; said receiving section accommodates at least a part of the tongue in the inner surface of the receiving section when the cover section is bent; and said cover section has a reinforcing section on a part of said cover section other than said receiving section.

* * * * *